US006393747B1

(12) United States Patent
Lewis

(10) Patent No.: US 6,393,747 B1
(45) Date of Patent: May 28, 2002

(54) WINDSHIELD DOCUMENT PROTECTING DEVICE

(76) Inventor: John Lewis, 90 Birch La., New City, NY (US) 10956

( * ) Notice: Subject to any disclaimer, the term of this patent is extended or adjusted under 35 U.S.C. 154(b) by 0 days.

(21) Appl. No.: 09/566,145

(22) Filed: May 5, 2000

(51) Int. Cl.[7] ..... G09F 21/04; G09F 3/00

(52) U.S. Cl. ..... 40/593; 283/81; 40/643; 40/661; 40/644

(58) Field of Search ..... 40/643, 593, 644, 40/661.11, 661; 283/81, 107, 108, 109, 101, 74, 110, 100; 224/277

(56) References Cited

U.S. PATENT DOCUMENTS

| | | | | |
|---|---|---|---|---|
| 1,430,282 | A | | 9/1922 | Bridgham |
| 1,681,375 | A | | 8/1928 | Shook |
| 3,533,178 | A | * | 10/1970 | Strohmaier |
| 4,184,276 | A | | 1/1980 | Hernandez |
| 4,864,755 | A | * | 9/1989 | Owens ..... 40/661.11 |
| 5,502,912 | A | * | 4/1996 | LeBoff et al. ..... 40/643 |
| 5,819,198 | A | * | 10/1998 | Peretz |
| 6,299,213 | B1 | * | 10/2001 | Souparis ..... 283/81 |

FOREIGN PATENT DOCUMENTS

| | | | |
|---|---|---|---|
| FR | 2622851 | * | 5/1989 |
| GB | 2191988 | * | 12/1987 |
| GB | 2207274 | * | 1/1989 |
| GB | 2231551 | * | 11/1990 |

* cited by examiner

*Primary Examiner*—Douglas C. Butler
(74) *Attorney, Agent, or Firm*—Goldstein Law Offices, P.C.

(57) ABSTRACT

A windshield document protecting device including a panel having a front face and a back face. The front face has an adhesive disposed thereon. The front face has a document receiving recess formed therein. The recess is dimensioned for receiving registration and inspection stickers therein whereby the registration and inspecting stickers face the front face. The panel is affixed to the windshield with the registration and inspection stickers visible by looking through the windshield from outside the vehicle.

4 Claims, 2 Drawing Sheets

Fig. 3
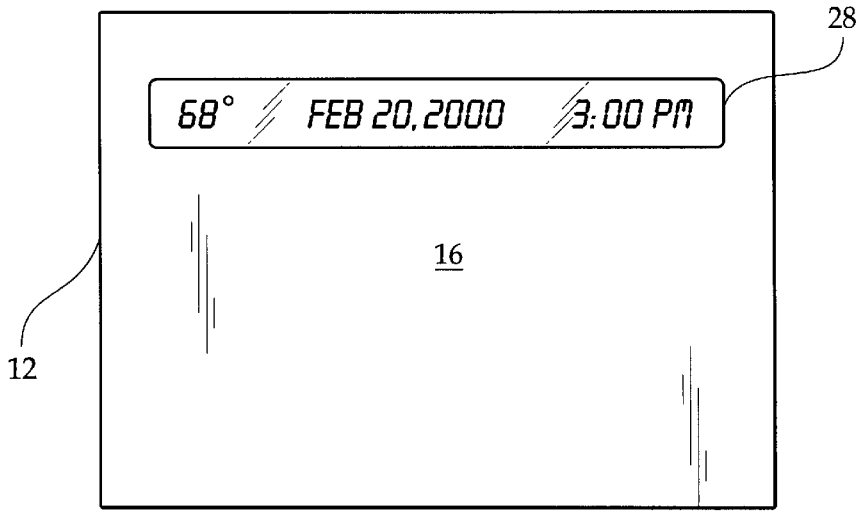
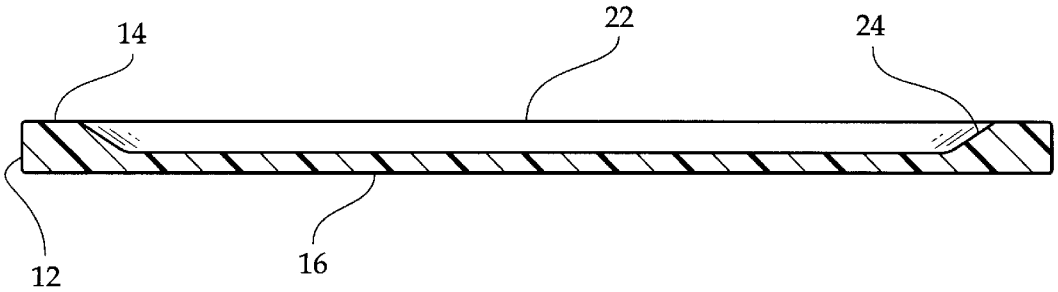
Fig. 4

WINDSHIELD DOCUMENT PROTECTING DEVICE

BACKGROUND OF THE INVENTION

The present invention relates to a windshield document protecting device and more particularly pertains to adhering to an interior of a vehicle's windshield to prevent damage to registration and inspection stickers normally affixed to the windshield.

The use of document protection devices is known in the prior art. More specifically, document protection devices heretofore devised and utilized for the purpose of protecting documents are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,184,276 to Hernandez discloses a motor vehicle registration holder comprised of a flexible U-shaped material capable of being affixed to a windshield. U.S. Pat. No. 1,681,375 to Shook discloses a device for holding a certificate against a glass surface, such as a vehicles windshield. U.S. Pat. No. 1,430,282 to Bridgham discloses a card holder for documents, such as vehicle registration certificates, comprised of a rectangular frame and a shallow metallic tray.

While these devices fulfill their respective, particular objective and requirements, the aforementioned patents do not describe a windshield document protecting device for adhering to an interior of a vehicle's windshield to prevent damage to registration and inspection stickers normally affixed to the windshield.

In this respect, the windshield document protecting device according to the present invention substantially departs from the conventional concepts and designs of the prior art, and in doing so provides an apparatus primarily developed for the purpose of adhering to an interior of a vehicle's windshield to prevent damage to registration and inspection stickers normally affixed to the windshield.

Therefore, it can be appreciated that there exists a continuing need for a new and improved windshield document protecting device which can be used for adhering to an interior of a vehicle's windshield to prevent damage to registration and inspection stickers normally affixed to the windshield. In this regard, the present invention substantially fulfills this need.

SUMMARY OF THE INVENTION

In the view of the foregoing disadvantages inherent in the known types of document protection devices now present in the prior art, the present invention provides an improved windshield document protecting device. As such, the general purpose of the present invention, which will be described subsequently in greater detail, is to provide a new and improved windshield document protecting device which has all the advantages of the prior art and none of the disadvantages.

To attain this, the present invention essentially comprises a rectangular panel having a front face and a back face. The front face has an adhesive disposed thereon. The front face has a document receiving recess formed therein. The recess is dimensioned for receiving registration and inspection stickers therein whereby the registration and inspecting stickers face the front face. The recess is formed with tapered edges. A data display is disposed within the back face of the rectangular panel. The display has means for displaying outside temperature, time of day, and current date.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved windshield document protecting device which has all the advantages of the prior art document protection devices and none of the disadvantages.

It is another object of the present invention to provide a new and improved windshield document protecting device which may be easily and efficiently manufactured and marketed.

It is a further object of the present invention to provide a new and improved windshield document protecting device which is of durable and reliable construction.

An even further object of the present invention is to provide a new and improved windshield document protecting device which is susceptible of a low cost of manufacture with regard to both materials and labor, and which accordingly is then susceptible of low prices of sale to the consuming public, thereby making such a windshield document protecting device economically available to the buying public.

Even still another object of the present invention is to provide a new and improved windshield document protecting device for adhering to an interior of a vehicle's windshield to prevent damage to registration and inspection stickers normally affixed to the windshield.

Lastly, it is an object of the present invention to provide a new and improved windshield document protecting device including a panel having a front face and a back face. The front face has an adhesive disposed thereon. The front face has a document receiving recess formed therein. The recess is dimensioned for receiving registration and inspection stickers therein whereby the registration and inspecting stickers face the front face.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom plan view of the present invention illustrating the display thereof.

FIG. 4 is a cross-sectional view of the present invention as taken along line 4—4 of FIG. 1.

The same reference numerals refer to the same parts through the various figures.

DESCRIPTION OF THE PREFERRED EMBODIMENT

Figure 1:
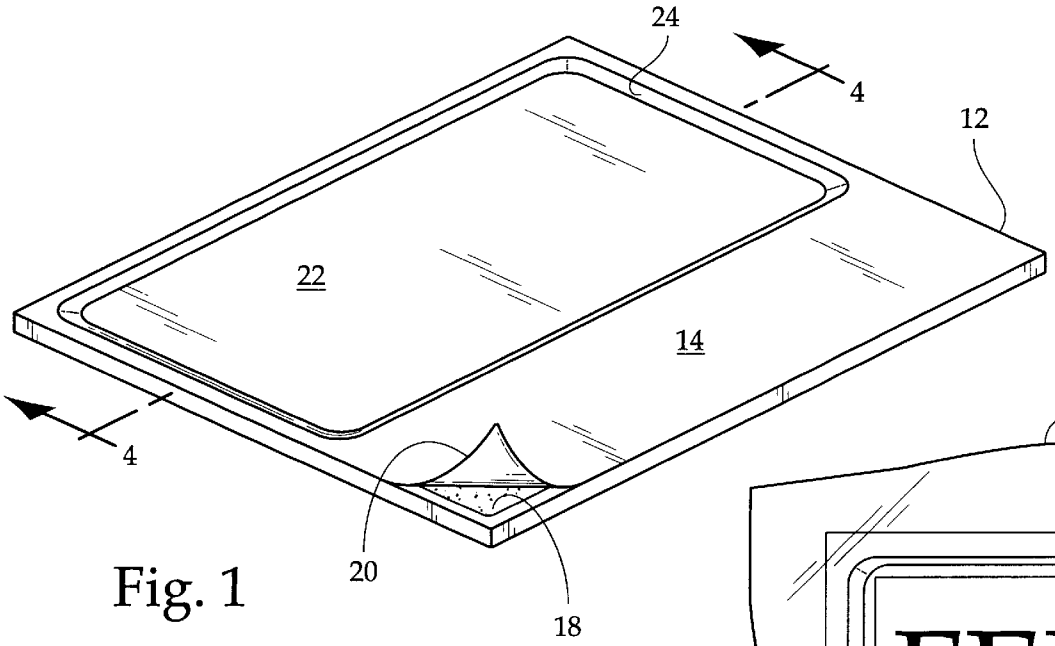
FIG. 1 is a perspective view of the preferred embodiment of the windshield document protecting device constructed in accordance with the principles of the present invention.
Figure 2:
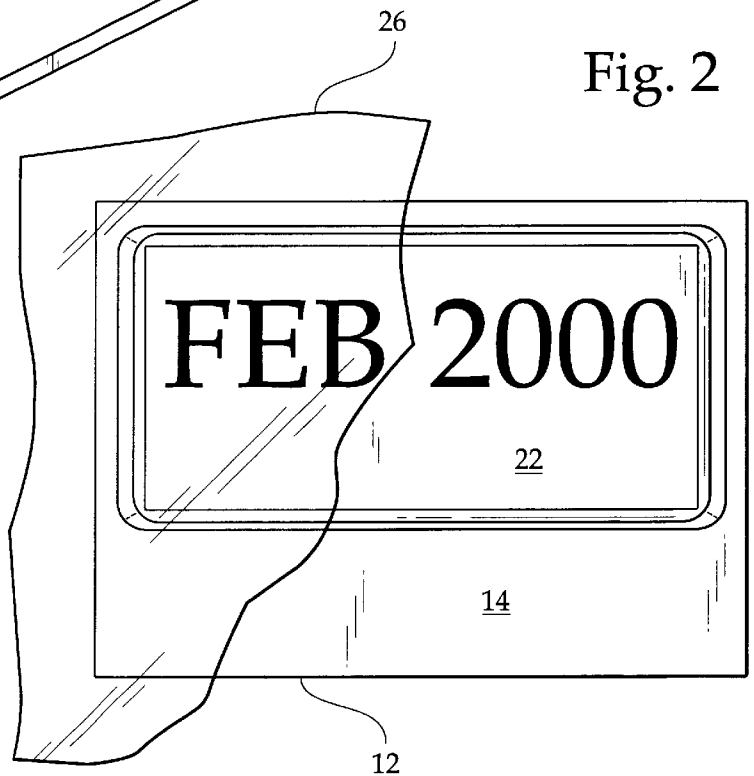
FIG. 2 is a top plan view of the present invention illustrated in use.

With reference now to the drawings, and in particular, to FIGS. 1 through 4 thereof, the preferred embodiment of the new and improved windshield document protecting device embodying the principles and concepts of the present invention and generally designated by the reference number 10 will be described.

Specifically, it will be noted in the various Figures that the device relates to a windshield document protecting device for adhering to an interior of a vehicle's windshield to prevent damage to registration and inspection stickers normally affixed to the windshield. In its broadest context, the device consists of a rectangular panel and a data display. Such components are individually configured and correlated with respect to each other so as to attain the desired objective.

"The rectangular panel 12 has a front face 14 and a back face 16. The front face 14 has an adhesive 18 disposed thereon. A protective layer 20 is provided that is disposed over the adhesive 18 prior to use. The front face 14 has a document receiving recess 22 formed therein. The recess 22 is dimensioned for receiving registration and inspection stickers therein whereby the registration and inspecting stickers face the front face 14. The recess 22 is formed with tapered edges 24 that enclose the recess on all sides. The registration and inspection stickers are placed within the recess 22 with the relevant information facing outwardly. The protective layer 20 is removed to expose the adhesive 18 and the panel 12 is affixed to an interior surface of the windshield 26. Note FIG. 2. Thus, the relevant information can be viewed from outside the vehicle by law enforcement officials and the like."

The data display 28 is disposed within the back face 16 of the rectangular panel 12. The display 28 has means for displaying outside temperature, time of day, and current date. The data display 28 could also be used to provide other relevant information related to the operation of the vehicle. In the preferred embodiment, the data display is disposed towards an upper edge of the rectangular panel 12 for easy viewing by a driver of the vehicle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A windshield document protecting device for adhering to an interior of a vehicle's windshield to prevent damage to registration and inspection stickers normally affixed to the windshield comprising, in combination:

a rectangular panel having a front face and a back face, the front face having an adhesive disposed thereon, the front face having a document receiving recess formed therein, the recess being dimensioned for receiving registration and inspection stickers therein whereby the registration and inspecting stickers face the front face, the recess being formed with tapered edges that enclose the recess on all sides;

a data display disposed within the back face of the rectangular panel, the display having means for displaying outside temperature, time of day, and current date.

2. A windshield document protecting device for adhering to an interior of a vehicle's windshield to prevent damage to registration and inspection stickers normally affixed to the windshield comprising, in combination:

panel having a front face and a back face, the front face having an adhesive disposed thereon, the front face having a document receiving recess formed therein, the recess being dimensioned for receiving registration and inspection stickers therein whereby the registration and inspecting stickers face the front face, the recess being formed with tapered edges that enclose the recess on/all sides.

3. The windshield document protecting device as set forth in claim 2 and further including a data display disposed within the back face of the rectangular panel.

4. The windshield document protecting device as set forth in claim 3 wherein the display has means for displaying outside temperature, time of day, and current date.

* * * * *